United States Patent [19]

Freeman

[11] Patent Number: 4,530,685

[45] Date of Patent: Jul. 23, 1985

[54] DISPLAY BOX ASSEMBLY

[76] Inventor: Sandra D. Freeman, 2733 W. Avenue 13, Los Angeles, Calif. 90065

[21] Appl. No.: 467,342

[22] Filed: Feb. 17, 1983

Related U.S. Application Data

[62] Division of Ser. No. 284,722, Jul. 20, 1981, Pat. No. 4,382,344.

[51] Int. Cl.[3] ..... B31B 1/62

[52] U.S. Cl. ..... 493/151; 493/909; 493/912; 493/162; 493/397; 40/539; 229/23 R; 229/28 R

[58] Field of Search ..... 493/150, 151, 162, 920, 493/89, 90, 162, 397, 966, 92, 312, 138, 909, 912; 40/124.4, 539; 229/16 D, 23 R, 27, 28 R

[56] References Cited

U.S. PATENT DOCUMENTS

| | | | |
|---|---|---|---|
| 1,892,194 | 12/1932 | Taylor | 40/539 |
| 2,887,834 | 5/1959 | Guyer | 493/162 |
| 3,575,286 | 4/1971 | Rosenburg | 493/90 |
| 4,005,644 | 2/1977 | Tranquillitsky | 493/151 |

*Primary Examiner*—Daniel C. Crane

*Assistant Examiner*—David B. Jones

*Attorney, Agent, or Firm*—John T. Matlago

[57] ABSTRACT

A box assembly comprising a series of three corner connected boxes is formed from a unitary blank of sheet material. The unitary blank is suitably cut and scored to include along the length thereof twelve body panels, two pairs of tabs, each pair spaced apart by an even number of body panels, and a flap on the end of the blank. In addition, closing flaps are suitably cut and scored on the tops and bottoms of selected ones of the body panels for use in closing off the openings on the tops and bottoms of the individual boxes of the assembly. To fabricate the box assembly from the blank, the tabs of each pair of tabs are folded and glued back on themselves to form a joining flap. An adhesive is then placed on the surfaces of each of the joining flaps and the end flap. The blank is then folded over on itself such that six of the body panels on the blank are superimposed over the remaining six. When so folded and glued, the blank is formed into a body assembly which is in a collapsed condition and need be merely opened up to provide the series of three corner connected boxes.

6 Claims, 20 Drawing Figures

DISPLAY BOX ASSEMBLY

CROSS REFERENCE TO RELATED APPLICATION

This application is a division of application Ser. No. 284,722, filed July 20, 1981 and now U.S. Pat. No. 4,382,344.

BACKGROUND OF THE INVENTION

This invention relates to boxes made of sheet material and more particularly to improvements in the structure and fabrication thereof.

It is highly desirable to provide a plurality of boxes which are joined in series by their corners to form a single assembly. Such a box assembly can be used, for example, for the packaging and display of related products, thus enhancing the sale thereof. The cost of such a box assembly can be reduced if the walls of the boxes and the flaps needed for joining the corners of the boxes are made of a unitary blank of sheet material. Moreover, the cost of such a box assembly can be further reduced if it can be formed on a single pass of the unitary blank through a standard folding and gluing machine. Thus, when the completed box assembly comes out of the machine it is in a collapsed condition in which it can be conveniently stored and shipped and, upon reaching the user, need be merely opened up for use.

SUMMARY OF THE INVENTION

In accordance with the present invention, a series of corner connected boxes is formed from a unitary blank of sheet material. The unitary blank is suitably cut and scored to include along the length thereof a plurality of body panels, one or more pairs of narrow tabs, each pair spaced apart by an even number of body panels, and a narrow flap on at least one end of the blank. In addition, closing flaps are suitably cut and scored on the tops and bottoms of selected ones of the body panels for use in closing off the tops and bottoms of the individual boxes of the assembly.

In the fabrication of the box assembly from the blank, in accordance with the present invention, the tabs in each pair of tabs are folded and glued back on themselves to form a joining flap. An adhesive is then placed on the surfaces of each of the joining flaps and the end glap. The blank is then folded over inwardly on itself from one or both ends thereof such that half of the body panels on the blank are superposed over the remaining half of the body panels, resulting in each of the joining flaps and the end flap being respectively glued to the marginal side of an opposing body panel. When so folded and glued, the blank is formed into a box assembly which is in a collapsed condition and need be merely opened up to provide the series of corner connected boxes.

It is accordingly an object of the present invention to provide a series of corner connected display boxes which can be fabricated in a simple and economical manner from a unitary blank.

Another object of the present invention is to provide a unitary blank having defined therein a plurality of body panels, at least one pair of tabs, and at least one end flap, these portions being so related and joined when the blank is folded and glued in a collapsed condition that when erected it forms a series of corner connected boxes.

Another object of the present invention is to provide for fabricating a series of corner connected display boxes from a unitary blank in a single pass thereof through a folding and gluing machine.

Another object of the present invention is to provide a unitary blank of sheet material which has been suitably cut and scored such that upon being passed through a folding and gluing machine it forms a series of corner connected boxes having advertising portions extending from the rear walls thereof.

Yet another object of the present invention is to provide a unitary blank of sheet material which has been suitably cut and scored such that upon being passed through a folding and gluing machine it forms a series of corner connected boxes wherein the heights of the boxes may vary.

Still another object of the present invention is to provide a multiple box structure which is easy to fabricate out of a unitary blank of sheet material and which when completely formed lies flat and can be readily erected to provide a series of corner connected boxes having a neat and attractive appearance thereby especially adapting it for the display of products.

With these and other objects in view, the invention consists in the construction, arrangement and combination of the various parts of the device, whereby the objects contemplated are attained as hereinafter set forth, pointed out in the appended claims and illustrated in the accompanying drawings.

DESCRIPTION OF THE PREFERRED EMBODIMENTS

Figure 1:
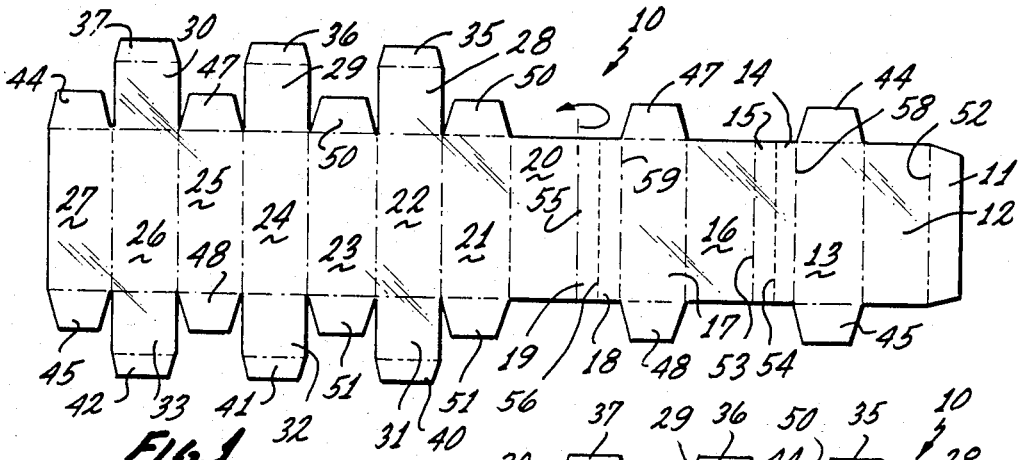
FIG. 1 is a plan view of a blank for forming the assembly of boxes of the present invention.

Reference will first be made to FIGS. 1 to 8, inc., which shows a series of three corner connected boxes 60, 61 and 62 formed of a unitary blank of sheet material in accordance with the present invention. As seen in FIG. 1, the blank 10, which is shown with the inside surfaces of the panels of the boxes directed upwardly, is cut and scored to sequentially include, starting from the right end thereof, an end flap 11, body panels 12 and 13, a first pair of tabs 14 and 15, body panels 16 and 17, a second pair of tabs 18 and 19, and body panels 20, 21, 22, 23, 24, 25, 26 and 27. It should be noted that the first pair of tabs 14 and 15 is spaced from the second pair of tabs 18 and 19 by two body panels.

The body panels 12, 13, 16, 17 and 20 through 27 are all rectangularly shaped and of the same size. Each of the tabs 14, 15 and 18, 19 and the end flap 11 is preferably on the order of one third the width of a body panel, although they may be made wider to reinforce the box walls.

The body panels 22, 24 and 26 are respectively provided with top covers 28, 29 and 30, and bottom covers 31, 32 and 33. In addition, the end of the top covers 28, 29 and 30 are respectively provided with tuck-in flaps 35, 36 and 37, and the ends of the bottom covers 31, 32 and 33 are respectively provided with tuck-in flaps 40, 41 and 42. Each of the body panels 13 and 27 is provided with a top flap 44 and a bottom flap 45, each of the body panels 17 and 25 is provided with a top flap 47 and a bottom flap 48, and each of the body panels 21 and 23 is provided with a top flap 50 and a bottom flap 51.

Figure 2:
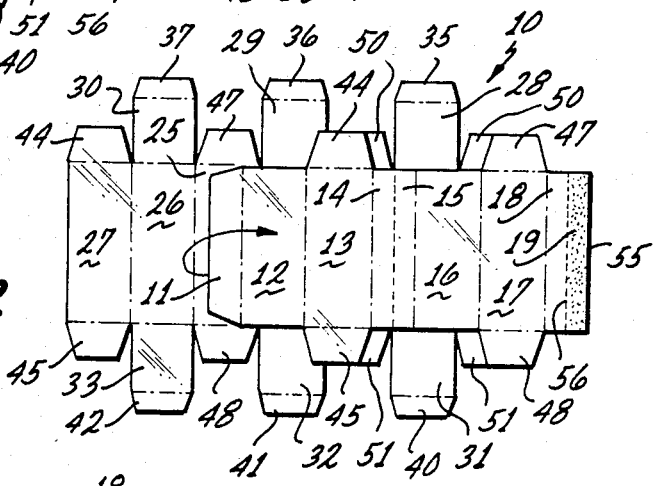
FIG. 2 is a plan view showing the first stage of forming a first joining flap from a first pair of tabs on the blank in FIG. 1.
Figure 3:
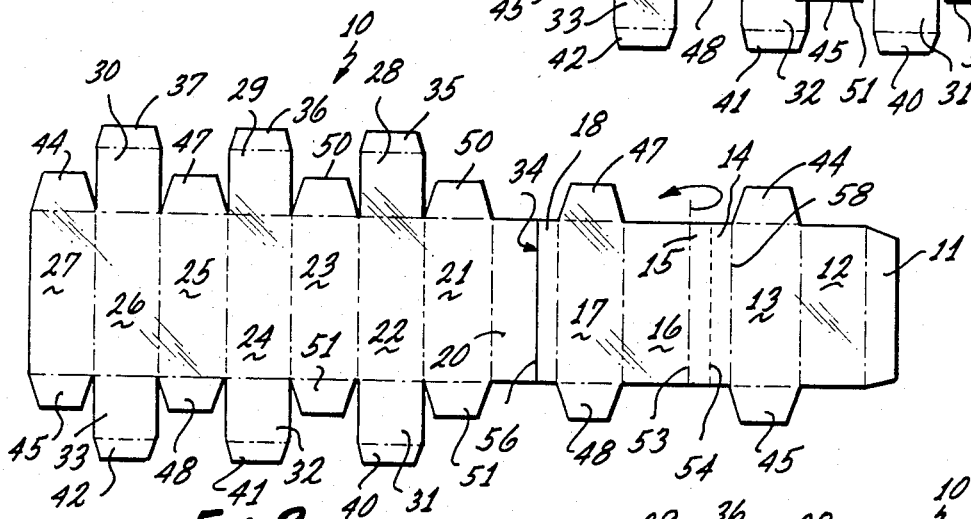
FIG. 3 is a plan view showing the final stage of forming the first joining flap from the first pair of tabs on the blank in FIG. 1.

To form the corner connected series of three boxes 60, 61 and 62 of the present invention from the blank 10, the right end portion of the blank 10 is first folded inwardly to the left along score line 55, as shown in FIG. 2. An adhesive is then applied to the exposed surface of tab 19. Then, as shown in FIG. 3, the end portion is folded back out to the right on score line 56. This causes the surface of tab 18 to lie over and be glued to the adjoining surface of tab 19 to form a first joining flap 34.

Figure 4:
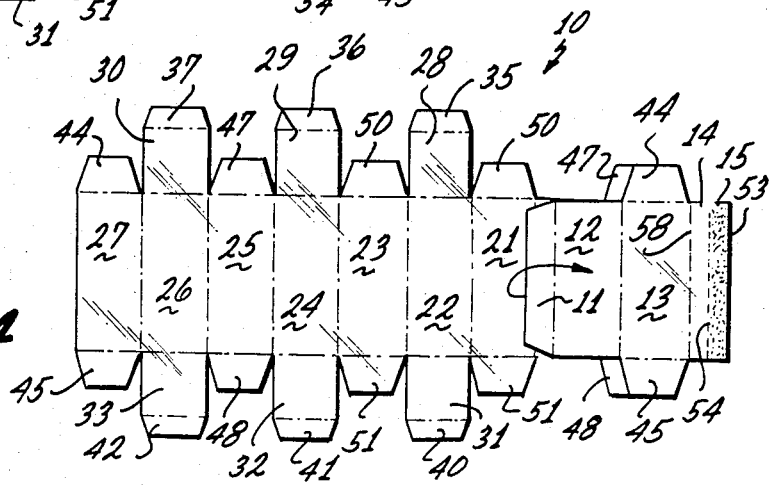
FIG. 4 is a plan view showing the first stage of forming a second joining flap from a second pair of tabs on the blank in FIG. 1.
Figure 5:
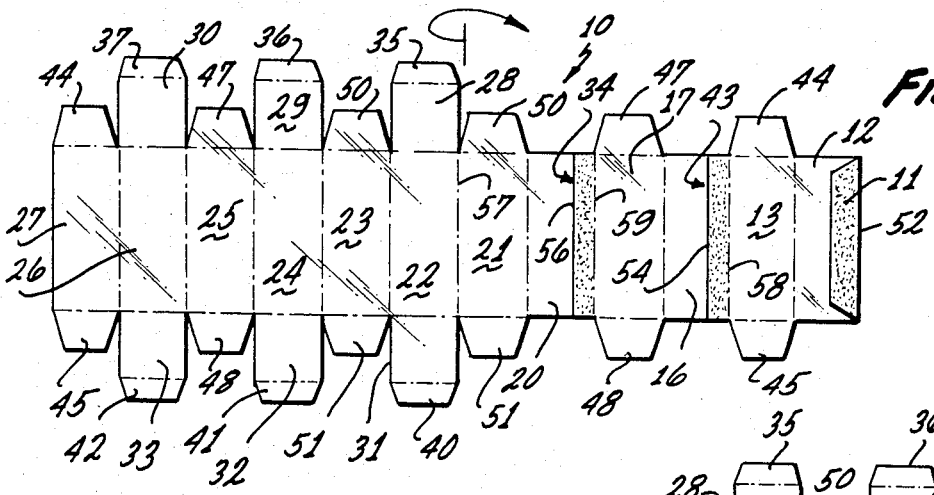
FIG. 5 is a plan view showing the final stage of forming the second joining flap from the second pair of tabs on the blank in FIG. 1.

A shorter right end portion of blank 10 is then folded inwardly to the left along score line 53, as shown in FIG. 4. An adhesive is applied to the exposed surface of the tab 15. Then, as shown in FIG. 5, the end portion is folded back out to the right on score line 54. This causes the outside surface of tab 14 to lie over and be glued to the outside surface of tab 15 to form a second joining flap 43. The order of forming the first joining flap 34 and the second joining flap 43 can, of course, be reversed. At this time the end flap 11 is also folded along score line 52 to the left. An adhesive is then applied to the exposed surface of end flap 11, and the exposed surfaces of each of the joining flaps 34 and 43.

Figure 6:
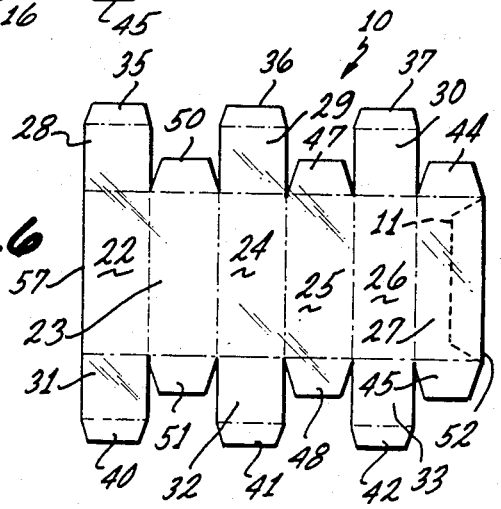
FIG. 6 is a plan view showing the assembly of boxes formed from the blank in FIG. 1 in a collapsed condition.

Now then, the left half of the blank 10 is folded along score line 57 over the right half thereof such that body panels 26 and 27 respectively overlie body panels 13 and 12, body panels 24 and 25 respectively overlie body panels 17 and 16, and body panels 22 and 23 respectively overlie body panels 21 and 20 as illustrated in FIG. 6. As a result, the marginal edge portion of body panel 27 is glued to end flap 11, the marginal edge portion of body panel 25 is glued to joining flap 43 and the marginal edge portion of body panel 23 is glued to the joining flap 34. It should be noted that the flap 11 could be provided on body panel 27 in which event it would be glued to the marginal edge portion of body panel 12.

it should now be clearly understood that the series of boxes 60, 61 and 63 is formed from a unitary blank 10 of relativly stiff sheet material which is suitably cut and scored to form the body panels, the first and second pairs of tabs used to form the first and second joining flaps, the end flap, and the covers and flaps for closiing off the top and bottom openings of the boxes.

It should now be especially noted that all of the steps of folding are along vertical score lines and the steps of applying glue are along vertical paths so that all of these steps can be readily performed on a single pass of the blank through a standard box forming machine such that when the blank comes out of the machine it takes the form of the assembly of boxes in a collapsed condition, i.e., a condition in which the assembly of boxes can be readily stored and shipped. Then, upon reaching the user, the folded and glued collapsed blank need be merely opened up to setup the boxes for use.

Figure 6A:
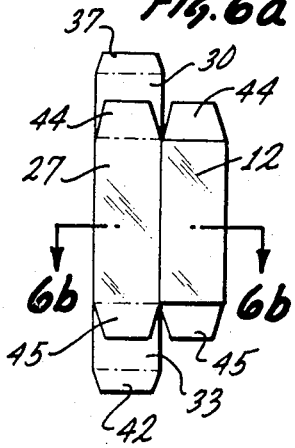
FIG. 6*a* is a plan view showing the flat folded blank of FIG. 6 after it has been refolded into a collapsed condition by pushing the ends of the assembly of boxes together.
Figure 6B:
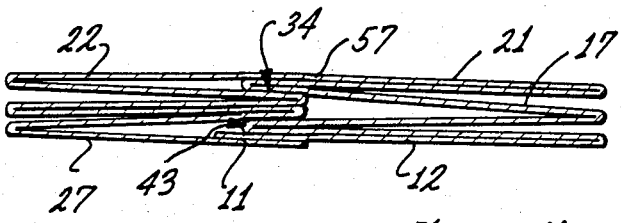
FIG. 6*b* is an enlarged sectional view taken along line 6*b*—6*b* of FIG. 6*a;*

It should be noted that the assembly of boxes in its collapsed condition, as shown in FIG. 6, can be refolded by pushing in on its ends, such that the body panels of the respective panels are collapsed against each other in an accordian manner, as illustrated in FIG. 6*a* and 6*b*. Such a folding provides a collapsed condition of the assembly of boxes that is only two body panels wide and is of advantage in that it fits into a standard size envelope for mailing.

Figure 7:
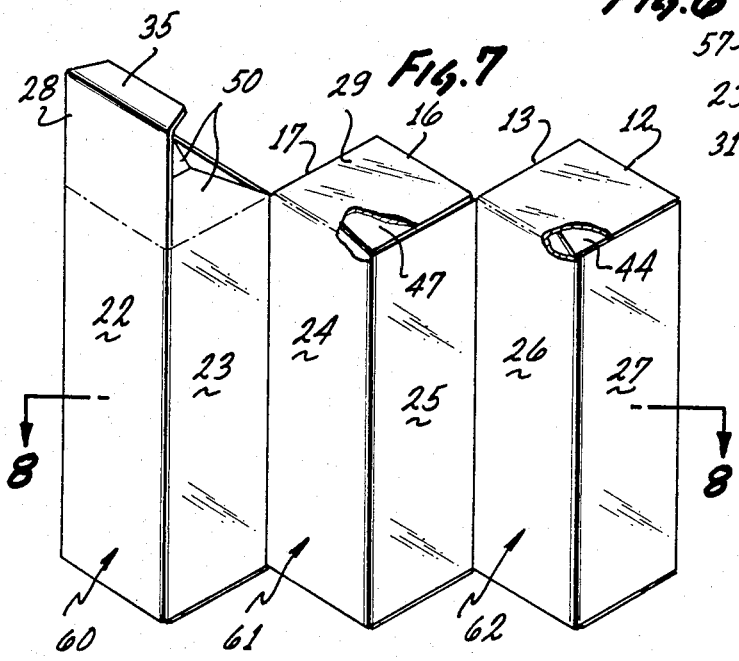
FIG. 7 shows an enlarged perspective view of the assembly of boxes formed by opening up the folded and glued blank in FIG. 6.
Figure 8:
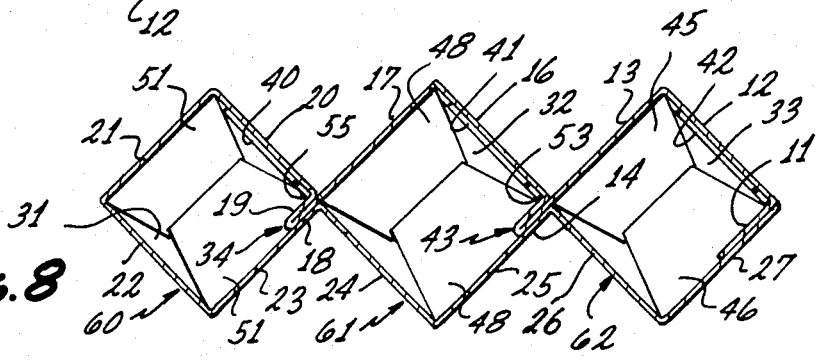
FIG. 8 shows an enlarged cross sectional view of the assembly of boxes as taken along line 8—8 of FIG. 7.

The assembly of boxes in its collapsed condition, as shown in FIG. 6, can be erected, i.e., set up, by pushing inwardly on its ends so that each of the three boxes 60, 61 and 62 assumes a square cross sectional configuration, as shown in FIG. 8. Thus, as seen in FIGS. 7 and 8, the walls of the box 60 are comprised of body panels 20, 21, 22 and 23, the walls of box 61 are comprised of body panels 16, 17, 24 and 25, and the walls of box 62 are comprised of body panels 12, 13, 26 and 27.

Furthermore, as best seen in FIG. 8, the outer end corner of the end box 62 is formed by the end flap 11 being glued to the body panel 27. Moreover, the joining flap 43 is joined by adhesive to the body panel 25 so as to hold body panel 13 parallel to the body panel 25 of the middle box 61 and the joining flap 43 is bent along score line 53 at right angles relative to the body panel 16 of box 61. Likewise, the joining flap 34 on the body panel 17 of the middle box 60 is joined by adhesive so as to hold body panel 17 parallel to body panel 23 of the end box 60 and the joining flap 34 is bent along score line 55 at right angles relative to the body panel 20 of box 60. Thus, the middle box 61 is joined at its diagonally opposite corners to corners of the end boxes 60 and 62, respectively.

FIG. 8 shows the bottom flaps 51, 48 and 45 and the bottom covers 31, 32 and 33 of respective boxes 60, 61 and 62 folded inwardly to cover the bottom openings thereof and held in position by tuck-in flaps 40, 41 and 42, respectively. FIG. 7 shows the top flaps 47 and 44 and the top covers 29 and 30 of the respective boxes 61 and 62 folded inwardly to cover the top openings thereof and held in position by tuck-in flaps 36 and 37, respectively. FIG. 7 further shows the top flaps 50 of body panels 21 and 23 in position to cover the top opening of box 60, with the top cover 28 thereof in open position. The folding of the bottom flaps 45, 48 and 51 and the bottom covers 33, 32 and 31 with the tuck-in flaps 40, 41 and 40 in position on the respective boxes 62, 61 and 60 help to hold the boxes in their square cross sectional configuration when the top covers of the respective boxes are opened.

It should be understood that the tab 14 and the tab 18 need not be provided with score lines 58 and 59 where they respectively join body panels 13 and 17 since in the embodiment disclosed the blank 10 is never folded along these lines during the forming of the assembly of boxes. Removing the score lines 58 and 59 helps to hold and maintain the body panels 13 and 17 parallel to the respective body panels 25 and 23 upon erection of the assembly of boxes.

The blank may be made of a sheet material varying from a cover paper to a relatively stiff cardboard. When a heavier grade of sheet material having a thickness of 0.010 inches or more is used for the blank 10, it is helpful to form the scores lines 54 and 56 between the tabs of the respective pairs of tabs with a series of short slits or perforations. This aids in relieving the tension of the fold when each of the pairs of tabs 18, 19 and 14, 15 is folded back on itself.

It should be noted from FIG. 5 that the joining flap 34 can be folded to the right on score line 59, if desired. As best noted in FIG. 8, if the joining flap 34 were so positioned, both joining flaps 34 and 43 would be disposed within the middle box 61, leaving the inner walls of both outer end boxes 60 and 62 unobstructed by the presence of a joining flap. As will be further evident from FIG. 8, joining flap 43 can also be folded, if desired, during forming of the blank 10 so as to be outside of the middle box 61 and glued to the body panel 26 of box 62, thus leaving the inner walls of the middle box 61 unobstructed by the presence of joining flaps. This flexibility of the positioning of the joining flaps is especially important when the individual boxes in the assembly of boxes are of different heights as will be subsequently discussed.

Figure 9:
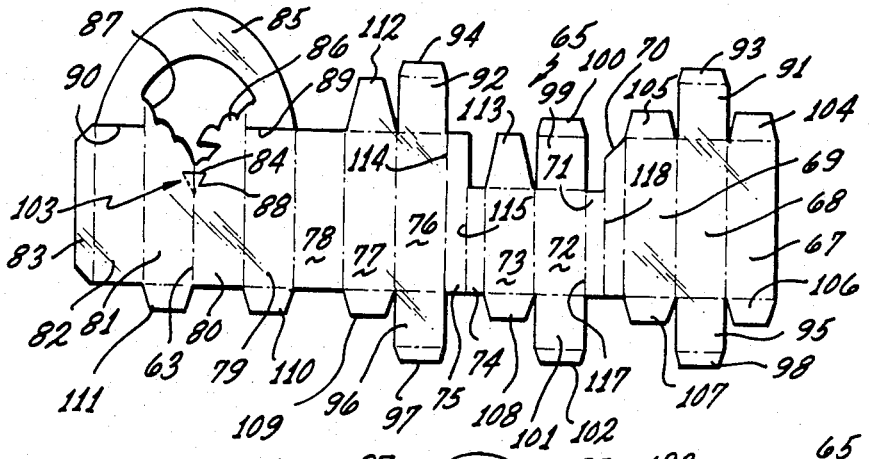
FIG. 9 is a plan view of another blank provided witn an advertising panel portion thereon for forming the assembly of boxes of the present invention.

Reference will next be made to FIGS. 9 to 13, inc. which show the series of three corner connected boxes 124, 125 and 126 formed of a unitary blank 65 in accordance with the present invention. As shown in FIG. 9, the blank 65 is suitably cut and scored to sequentially include, starting from the right end thereof, body panels 67, 68 and 69, a pair of tabs 70 and 71, body panels 72 and 73, a pair of tabs 74 and 75, body panels 76, 77, 78, 79, 80, 81 and 82, and an end flap 83. The pair of tabs 70 and 71 are spaced from the pair of tabs 74 and 75 by two body panels. It should be noted that body panels 72 and 73 are shorter then the other body panels. Cut on blank 65 to extend across the top panels 79 to 82, inc., is an arcuate portion 85 whose inner ends are integrally joined by portions 86 and 87 to the tops of body panels 80 and 81, respectively. Note that the dividing lines 89 and 90 between the arcuate portion 85 and body panels 79 and 82 are cut. Furthermore, a short horizontal slit 84 is provided across the score line 63 between body panels 80 and 81 at a height corresponding to the top of panel 73 and short angular scores 88 join the ends of the slit 84 to the score line 63 to form a triangular stop 103.

Body panels 68 and 76 are respectively provided with top covers 91 and 92 having tuck-in flaps 93 and 94, and with bottom covers 95 and 96 having tuck-in flaps 98 and 97. Body panel 72 is provided with a top cover 99 having a tuck-in flap 100 and a bottom cover 101 having a tuck-in flap 102.

Body panels 67 and 69 are provided with top side flaps 104 and 105 and bottom side flaps 106 and 107. Likewise, body panels 73, 77, 79 and 81 are respectively provided with bottom side flaps 108, 109, 110 and 111. In addition, body panels 77 and 73 are each provided with a single long top side flap 112 and 113, respectively.

Figure 10:
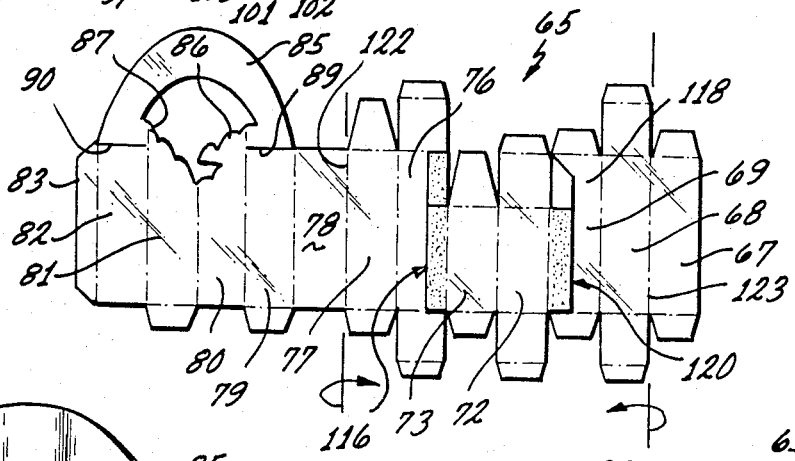
FIG. 10 is a plan view of the blank of FIG. 9 after the joining flaps have been formed thereon.

To form the joining flaps on blank 65, the right end portion of the blank 65 is folded back on itself on score line 114 toward the left. An adhesive is then applied to the exposed surface of tab 75 and then this portion is folded back on itself on score line 115 toward the right such that the joining flap 116 so formed is directed toward the left, as shown in FIG. 10. The right end portion of blank 65 is then folded to the left again along score line 117. An adhesive is then applied to the exposed surface of tab 71 and then this portion of blank 65 is folded on score line 118 back on itself toward the right. As a result of this fold the joining flap 120 formed would be directed toward the left. However, in this embodiment, because the middle box 125 is shorter then the end boxes 124 and 126, the joining flap 120 is refolded to the right, as shown in FIG. 10.

An adhesive is then applied to the exposed surfaces of joining flaps 116 and 120 and the bottom surface of end flap 83. The left end portion of the blank 65 is then folded toward the right along score line 122 and the right end portion of the blank 65 is then folded toward the left along score line 123.

Figure 12:
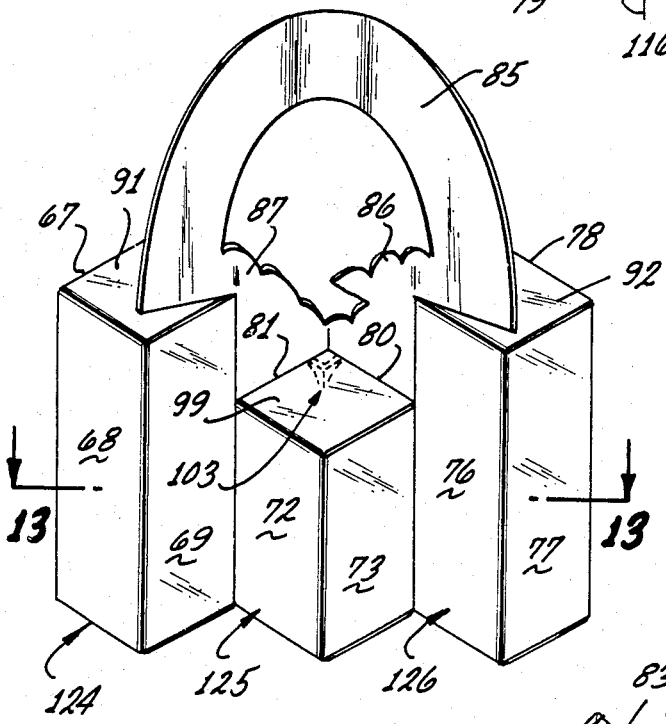
FIG. 12 shows an enlarged perspective view of the assembly of boxes formed by opening up the folded and glued blank in FIG. 11.
Figure 11:
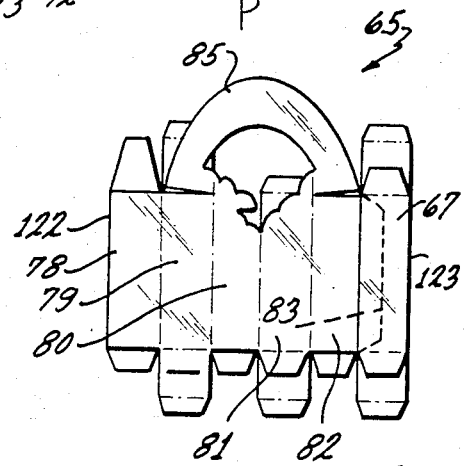
FIG. 11 is a plan view showing the assembly of boxes formed from the blank of FIG. 9 in a collapsed condition.
Figure 13:
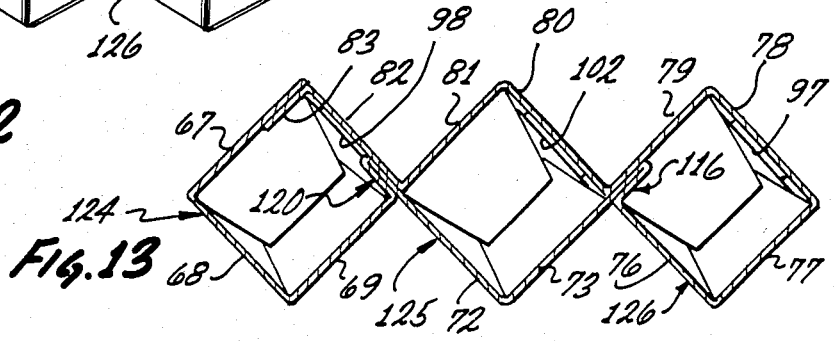
FIG. 13 shows an enlarged cross sectional view of the assembly of boxes as taken along line 13—13 of FIG. 12.

As a result of such folds, the end flap 83 is glued to the marginal edge portion of panel 67, the joining flap 120 is glued to the marginal edge portion of panel 82, and the joining flap 116 is glued to the marginal edge portion of panel 79. The plan view of the collapsed folded and glued blank 65 in FIG. 11 shows the back panels of the three box assembly facing upwardly. Now then, when the folded blank 65 is set up, i.e., opened up, the front view of the assembly of three corner connected boxes 124, 125 and 126 formed is shown in FIG. 12. As previously noted, the middle box 125 is shorter in height then the two end boxes 124 and 126. Moreover, the arcuate portion 85 of the blank 65 which is joined at its inner ends by portions 86 and 87 to the tops of panels 80 and 81 is slightly bowed and its free outer lower ends extend over the top covers 92 and 91 of the end boxes 126 and 124.

It should now be clearly understood that by locating the two pairs of tabs 70, 71 and 74, 75 on the unitary blank 65 so that when folded and glued in its final collapsed condition four successive body panels 79–82 are centered on the front or back halves thereof, it is possible to provide for the arcuate portion 85 to extend above these four body panels. Such a construction enables the arcuate portion 85 to always lie flat during the folding operation of the blank in the machine, as needed to form the joining flaps.

It should now be clear that one of the advantages of forming the series of corner connected boxes from the blank 65 is that the unfolded surface of the arcuate portion 85 which extends above and is integrally formed with the back panels 80 and 81 of the middle box 125 also extends over the end boxes 124 and 126. Thus, the arcuate portion 85 can be used to display advertising matter which has been printed thereon before the blank 65 is fed into the folding and gluing machine.

It will now be further understood that the choice of top and bottom cover and flap construction provided for the individual boxes in the assembly of boxes can vary depending on the presence of any advertising portions and the ease of accessibility desired into the interior of the individual boxes. For example, when an advertising portion such as 85 is provided on the upper edges of the rear body panels of the middle box 125 and extends over the tops of the end boxes, as shown in FIG. 12, it may be necessary to have a single top flap 113 on body panel 73 since the opposite body panel 81 can not be provided with such a flap due to the upwardly extending advertising portion 87 provided at that position of the blank 65. It should now be clear that the purpose of stop 103 between body panels 80 and 81 is to provide a support for the top cover 99 of box 125.

Figure 14:
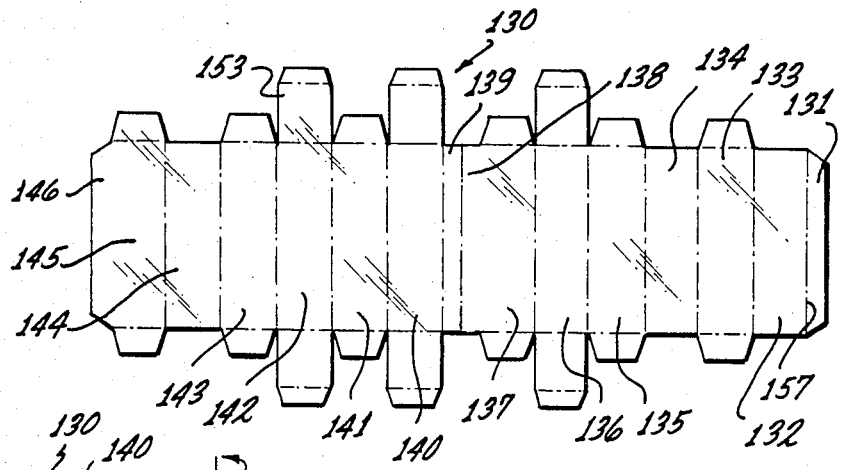
FIG. 14 is a plan view of still another blank for forming the assembly of boxes of the present invention.

Reference will next be made to FIGS. 14 to 18, inc., which show a series of three corner connected boxes 150, 151 and 152 formed of a simplified unitary blank 130 in accordance with the present invention. As shown in FIG. 14, the blank 130 includes, starting from the right end thereof, an end flap 131, body panels 132, 133, 134, 135, 136 and 137, a pair of tabs 138 and 139, body panels 140, 141, 142, 143, 144 and 145, and an end flap 146. It should be noted that all the panels are rectangularly shaped and of the same size. Furthermore, all the sides of the panels are scored except the side of panel 137 adjacent tab 138 and the side of panel 145 adjacent end flap 146.

Figure 15:
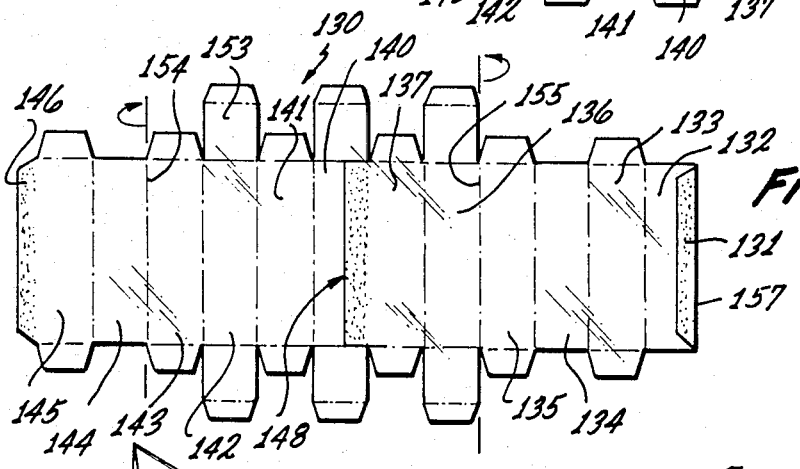
FIG. 15 is a plan view of the blank of FIG. 14 after the single joining flap has been formed thereon.
Figure 16:
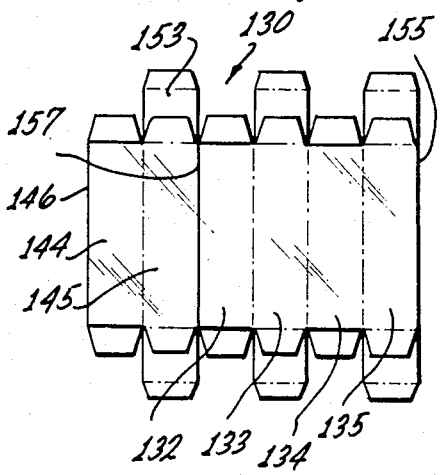
FIG. 16 is a plan view showing the assembly of boxes formed from the blank of FIG. 14 in a collapsed condition.
Figure 17:
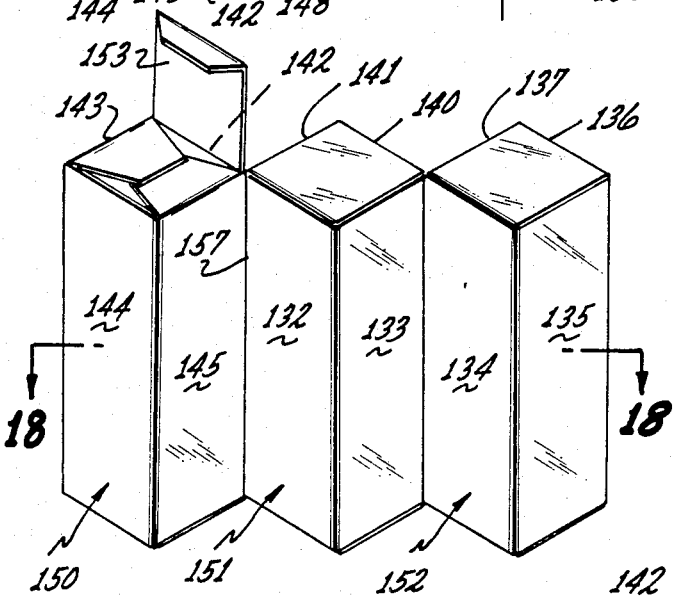
FIG. 17 shows an enlarged perspective view of the assembly of boxes formed by opening up the folded and glued blank in FIG. 16.
Figure 18:
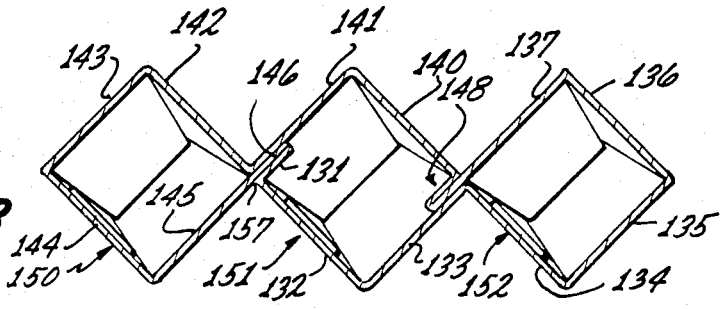
FIG. 18 shows an enlarged cross sectional view of the assembly of boxes as taken along line 18—18 of FIG. 17.

It should be particularly noted that in this embodiment the blank 130 is provided with only one pair of tabs 138 and 139 located between the middle two body panels 137 and 140. Consequently, as shown in FIG. 15, only one joining flap 148 need be formed in the manner previously shown and described in detail in connection with the blank in FIG. 1. As further shown in FIG. 15, the right end flap 131 is folded inwardly on score line 157. Then, an adhesive is applied to the exposed surfaces of the right end flap 131, the joining flap 148 and the left end flap 146. The left end portion of the blank 130 is then folded inwardly along score line 154 and the right end portion of the blank 130 is folded inwardly along score line 155. The completely folded and glued blank 130 is shown in FIG. 16. When the folded blank 130 in FIG. 16 is setup, it forms the series of corner connected boxes 150, 151, 152, as shown in FIG. 17. Thus, as best seen by the cross sectional view of the boxes in FIG. 18, the two end flaps 146 and 131 combine to join the corner of box 150 to one corner of box 151 and the joining flap 148 serves to join the diagonally opposite corner of box 151 to the corner of box 152.

It is thus seen that the embodiment of the three boxes 150, 151 and 152 formed by blank 130 is simpler to fabricate than the embodiment of the three boxes 60, 61 and 62 formed from the blank 10 (FIG. 1), inasmuch as only one joining flap 148 needs to be formed by folding the blank 130 in the folding and gluing machine.

It should now be understood that the series of corner connected boxes fabricated from the unitary blanks cut and scored in accordance with the present invention can take on many forms providing for a number of different uses. For example, the assembly of boxes enables related products to be placed in the separate boxes thus enhancing the sale thereof. Moreover, the three box assembly provides twelve external surfaces which enable them to be printed with the months of the year, and thus serve as a desk calendar. The fact that the box assembly in its collapsed condition as it comes out of the machine can be opened up and recollapsed in an accordian manner as shown in FIG. *6a*, so as to be only the width of two body panels, enables it to be fitted into a regular No. 10 size envelope suitable for mailing. Moreover, since the boxes of an assembly may be made of different sizes, the smaller ones can be used to enclose samples of related or new products which a manufacturer would like to introduce with the line of products carried in the larger boxes of the assembly. The ability to provide additional advertising portions on the blank which do not interfere with the forming of the joining flaps and the folding and gluing of the blank on passing through the folding and gluing machine is of great advantage when the box assembly is intended to be used for display purposes.

While the embodiments of the invention shown and described herein are admirably adapted to fulfill the objects and advantages previously mentioned as desirable, it is to be understood that the invention is not limited to the specific features shown and described but that the means and configurations herein disclosed are susceptible of modification in form, materials, proportions and arrangements of parts without departing from the principles involved or sacrificing any of its advantages and the invention therefore may be embodied in various forms within the scope of the appended claims.

What is claimed is:

1. A method for forming a series of corner connected boxes wherein each box in the series other than the end boxes has its diagonally opposite corners respectively joined to a corner of an adjacent box by a joining flap, said method comprising:

providing a unitary blank of sheet material which has been suitably cut and marked with parallel score lines to define along the length thereof body panels corresponding to the walls of said boxes, a plurality of pairs of narrow adjacent tabs, and a narrow flap on one end of said blank, each said pair of adjacent tabs disposed between two of the body panels forming a joining corner in said series of corner connected boxes;

moving said blank along a linear path with its inside surface facing upwardly;

forming a joining flap from each said pair of adjacent tabs by:

first folding an end portion of the blank that includes a pair of adjacent tabs inwardly on a scoreline whereat a tab in said pair connects to a body panel such that the outside surface of both tabs of said pair is facing upwardly;

applying glue to one tab of said pair of adjacent tabs, and then refolding said end portion of the blank back outwardly on the scoreline whereat one tab connects to the other tab of said pair of adjacent tabs whereby the tabs are glued together to provide a joining flap;

folding said end flap inwardly at its scoreline;

applying glue to the joining flaps and said end flap; and folding the blank such that half of the body panels are superimposed over the remaining half of the body panels thereon with each of the joining flaps respectively glued to the side portion of an opposing body panel forming a joining corner in said series and the end flap glued to the side portion of an opposing body panel forming a nonjoining corner in said series of corner connected boxes.

2. A method for forming a series of three corner connected boxes wherein the middle box has its diagonally opposite corners respectively joined to a corner of an end box in the series by a first and second joining flap;

providing a unitary blank of sheet material which has been suitably cut and marked with parallel score lines to define along the length thereof twelve body panels corresponding to the walls of said boxes, a pair of adjacent narrow tabs disposed between two of the body panels forming a joining corner in said series of boxes, and a narrow flap on each end of the blank;

moving said blank along a linear path with its inside surface facing upwardly;

folding an end portion of the blank that includes said pair of adjacent narrow tabs inwardly on a scoreline whereat a tab of said pair connects to a body panel such that the outside surface of both tabs of said pair is facing upwardly;

applying glue to one tab of said pair of adjacent tabs; and refolding said end portion of the blank back outwardly on the scoreline whereat one tab connects to the other tab of said pair of adjacent tabs whereby the tabs are glued together to provide said first joining flap;

folding one of the end flaps inwardly at its scoreline;

applying flue to the joining flap and both end flaps; and folding the blank such that six of the body panels are superimposed over the remaining six of the body panels with said first joining flap glued to the side portion of an opposing body panel forming one joining corner in the series, and with the unfolded end flap glued to the side portion of an opposing body panel forming the other joining corner in the series and with the folded end flap glued to the unfolded end flap to provide said second joining flap.

3. A method for forming a series of three corner connected boxes as defined in claim 2 wherein the scoreline is omitted between the unfolded end flap and its adjacent body panel, and between one of the tabs and its adjacent body panel.

4. A method for forming a series of three corner connected boxes as defined in claim 2 wherein portions on both ends of the blank are folded inwardly to superimpose six of the body panels over the remaining six of the body panels.

5. A method for forming a series of corner connected boxes wherein each box in the series other than the end boxes has its diagonally opposite corners respectively joined to a corner of an adjacent box by a joining flap, said method comprising:

providing a unitary blank sheet of material which has been suitably cut and scored with parallel scorelines to define along the length thereof body panels corresponding to the walls of said boxes, at least one pair of adjacent tabs narrower than said body panels disposed between two of said body panels, and an end flap narrower then said body panels disposed on each end of said blank, said at least one pair of adjacent tabs located between two of the body panels forming a joining corner in said series of boxes;

moving said blank along a linear path with its inside surface facing upwardly;

forming a joining flap from said at least one pair of adjacent tabs by:

first folding an end portion of the blank that includes a pair of adjacent tabs inwardly on a scoreline whereat a tab in said pair connects to a body panel such that the outside surface of both tabs of said pair of adjacent tabs is facing upwardly;

applying glue to one tab of said pair of adjacent tabs; and then refolding said end portion of the blank back outwardly on the scoreline whereat one tab connects to the other tab of said pair of adjacent tabs whereby the tabs are glued together to provide a joining flap;

folding one of the end flaps inwardly at its scoreline;

applying glue to said at least one joining flap and each end flap; and folding the blank such that half of the body panels are superimposed over the remaining half of the body panels thereon with said at least one joining flap glued to the side portion of an opposing body panel forming a joining corner and with the unfolded end flap glued to the side portion of an opposing body panel forming a joining corner and the folded end flap glued to the unfolded end flap to provide a joining flap.

6. A method for forming on a folding and gluing machine a series of corner connected boxes wherein each box in the series other then the end boxes has its diagonally opposite corners respectively joined to a corner of an adjacent box in the series by a joining flap, said method comprising:

providing a unitary blank which has been suitably cut and marked with scorelines to provide along the length thereof body panels corresponding to the walls of said boxes, a plurality of pairs of narrow adjacent tabs, each pair of adjacent tabs located between two of the body panels forming a joining corner in said series, and a narrow flap on one end of said blank;

feeding said blank through said folding and gluing machine along a linear path;

forming a joining flap from each pair of adjacent tabs by:

first folding an end portion of said blank inwardly on a scoreline whereat a tab of a pair of adjacent tabs connects to a body panel on the remaining portion of said blank;

applying glue to one tab of said pair of adjacent tabs; and then refolding said end portion of said blank back outwardly on a scoreline whereat one tab connects to the other tab of said pair of adjacent tabs whereby said tabs are glued together to provide a joining flap;

applying glue to the joining flaps and the end flap; and folding the blank such that half of the body panels are superimposed over the remaining half of the body panels with each of the joining flaps respectively glued to the side portion of an opposing body panel forming a joining corner in said series and with the end flap glued to an opposing body panel forming a nonjoining corner in said series.

* * * * *